United States Patent [19]

Ayers

[11] Patent Number: 5,067,186

[45] Date of Patent: Nov. 26, 1991

[54] BABY BIDET APPARATUS WITH RETRACTION AND HEIGHT ADJUSTMENT MEANS

[76] Inventor: Glenn Ayers, 2581 NE. 10 Ct., Pompano Beach, Fla. 33062

[21] Appl. No.: 360,767

[22] Filed: Jun. 2, 1989

[51] Int. Cl.[5] ..... A47K 3/00

[52] U.S. Cl. ..... 4/665; 4/420.3; 4/445; 4/572

[58] Field of Search ..... 4/665, 572, 547, 546, 4/549, 551, 584, 586-588, 576-577, 661, 300.2, 340, 341, 342, 553, 554, 420.3, 445

[56] References Cited

U.S. PATENT DOCUMENTS

| | | | |
|---|---|---|---|
| 1,288,347 | 12/1918 | Wilson | 4/553 |
| 1,490,028 | 4/1924 | Sauer | 4/572 X |
| 1,660,709 | 2/1928 | Hodgson | 4/665 |
| 2,053,594 | 9/1936 | Albert | 4/445 X |
| 2,358,003 | 9/1944 | De Puy | 4/572 |
| 2,507,848 | 5/1950 | Bashaw | 4/572 |
| 2,607,925 | 8/1952 | De Puy | 4/572 |
| 2,698,948 | 1/1955 | Levitt | 4/586 X |
| 2,715,736 | 8/1955 | Pearlson | 4/587 X |
| 2,724,839 | 11/1955 | Kennedy | 4/572 X |
| 2,760,208 | 8/1956 | Mussells | 4/572 |
| 3,094,711 | 6/1963 | Kentes | 4/586 X |
| 3,579,658 | 5/1971 | Choquette | 4/572 X |
| 3,995,331 | 12/1976 | Fotre et al. | 4/572 |
| 4,881,281 | 11/1989 | Lavoine et al. | 4/572 |

FOREIGN PATENT DOCUMENTS

| | | | |
|---|---|---|---|
| 204793 | 5/1939 | Switzerland | 4/420.3 |
| 985834 | 3/1965 | United Kingdom | 4/300.2 |

*Primary Examiner*—Henry J. Recla
*Assistant Examiner*—Robert M. Fetsuga
*Attorney, Agent, or Firm*—Stanley W. Sokolowski

[57] ABSTRACT

An infant's bidet is provided, which folds out of the way over a toilet. The bidet comprises a container with a drainer platform, inclined surfaces that direct waste into a bowl, an elevated child bearing platform, accessory shelves and height adjustment means.

1 Claim, 1 Drawing Sheet

BABY BIDET APPARATUS WITH RETRACTION AND HEIGHT ADJUSTMENT MEANS

BACKGROUND OF THE INVENTION

The present invention relates to an infant bath intended for safe, sanitary and convenient bathing of a child after it has soiled its diaper.

Prior art discloses baby baths that are portable, or attachable to sinks or drain into toilets. What is needed is a device that does not interfere with the conventional use of the toilet, and can be readily positioned for its application as a baby bidet. Further, it is desirable that the child be elevated above the drain water so the bath water will not redeposit contaminants on the child's skin. Also, ease of cleaning and storage have been found lacking in the prior art.

SUMMARY OF THE INVENTION

This bidet for infants provides a safe, sanitary, convenient and comfortable means to clean a child wherever a toilet and water faucet are available. The present invention provides just such an infant's bidet, which folds out of the way over a toilet. It comprises a container with a drainer platform, inclined surfaces that direct waste into a bowl, an elevated child bearing platform, accessory shelves and height adjustment means.

A principal object of the invention is to provide a baby bidet that cleans feces and urine from the infant efficiently, and disposes the waste.

Another object is to provide an infant bidet that does not interfere with the conventional use of the toilet, but can be readily brought into service as needed.

A further object is to provide a bidet that is economical in cost.

An additional object is to provide a baby bidet that is adjustable in height and is comfortable for the parent to use.

A further object is to provide an apparatus that can be conveniently cleaned.

Other objects will become apparent upon understanding the illustrative embodiments that are about to be descried, or will be indicated in the appended claims. The various advantages not referred to herein will occur to one skilled in the art upon employment of the invention in practice.

DETAILED DESCRIPTION OF THE INVENTION

Figure 1:
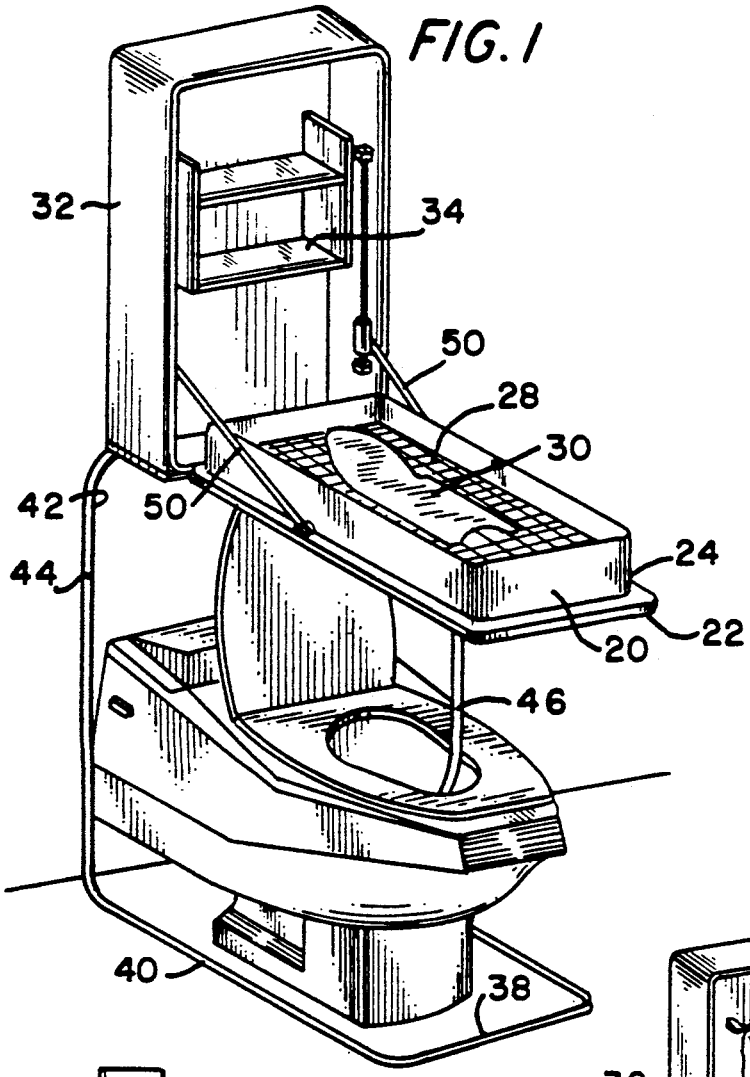
FIG. 1 is an isometric view of the babidet in position for use over a toilet.
Figure 3:
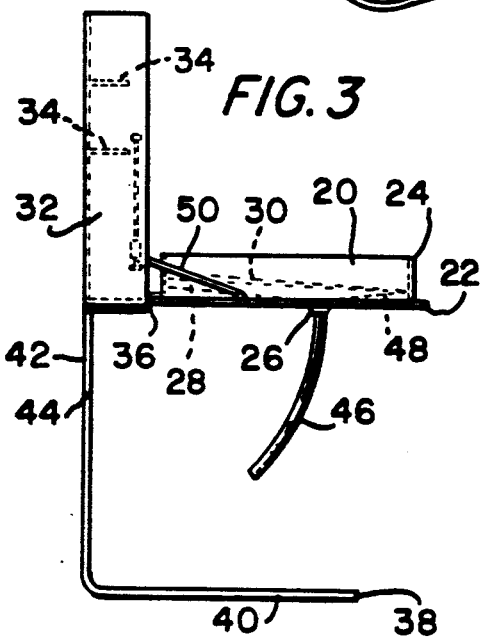
FIG. 3 is a side view of the invention opened for use.
Figure 2:
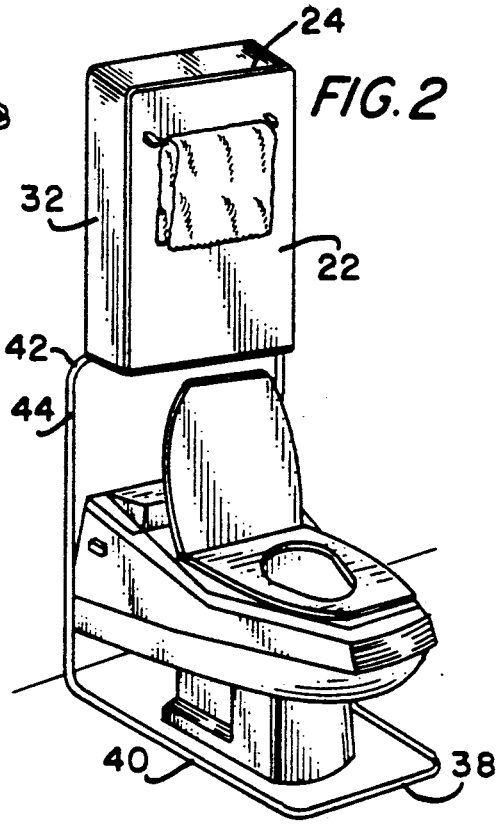

The apparatus shown in FIG. 2 comprises a container 20 having a bottom 22 and sides 24. The upper surface 48 of the bottom is sloped downward toward a vent 26. Above the upper surface is suspended a drainer 28 which may be a grid or a perforated platform. On the drainer is restrained a baby rest 30. The entire assembly can be nested in a console 32 which has shelves 34 for accessories like soap and powder. The console has a hinge means 36 and support arms 50 for convenience in collapsing the structure to occupy a minimum space. FIGS. 1 and 3 show that the support arms hold the container in its functional horizontal position, or in its retracted vertical mode. The entire assembly rests on a frame which unobtrusively straddles the toilet. The support frame 38 comprises a base 40 and a telescoping support 42 with a height adjusting means 44 that raises the apparatus to a working height comfortable for the infant's parent. A removable drain tube 46 is attached to the vent and directs the waste to the toilet bowl.

In operation the infant is placed on the body rest 30 and is protected from falling by the sides 24. The child may be cleaned by sponging from the reservoir such as an adjacent sink, or by means of a spray hose easily attached to a faucet. The dirty water will pass through the grid or perforations of the drainer 28, without recirculating and recontaminating the exposed surfaces of the child. This water is drained through the vent 26 and directed into the toilet bowl by the drain tube 46. After the child is quickly and safely cleaned and dried, he can be removed to a safe area, and the entire assembly is expeditiously cleaned by simply hosing down. The toilet is flushed, and the assembly retracted into the console so that the toilet may be used normally. The height of the baby bidet is typically adjusted only for the particular location and operator's comfortable working height.

As different embodiments of the present invention may be made without departing from the spirit and scope thereof, it is to be understood that the invention is not limited to the specific embodiments as described herein, except as defined in the appended claims.

What is claimed is:

1. An infant bath comprising:

an open container having a bottom and sides;

said bottom further having a sloped upper surface with the lowest portion of said sloped surface converging upon a vent;

a draining platform horizontally suspended above said bottom, and a body platform affixed to said draining platform, said body platform further comprising an inclined support surface above said draining platform;

a storage console having at least one convenience shelf, with hinge and support arm means for positioning the container relative to the console horizontally and alternately vertically concealably nested within said console;

the console further supported on a frame having a base with at least one telescoping vertical member having height adjustment means.

* * * * *